US005458202A

United States Patent [19]

Fellows et al.

[11] Patent Number: 5,458,202

[45] Date of Patent: Oct. 17, 1995

[54] PRESSURIZED EXTINGUISHANT RELEASE DEVICE WITH ROLLING DIAPHRAGM

[75] Inventors: Robert A. Fellows, San Ramon; Maurice E. Tyler, Orinda; Shailer T. Pickton, Lafayette, all of Calif.

[73] Assignee: Systron Donner Corporation, Concord, Calif.

[21] Appl. No.: 119,731

[22] Filed: Sep. 9, 1993

[51] Int. Cl.[6] ..... A62C 37/46

[52] U.S. Cl. ..... 169/58; 169/20; 169/60; 169/62

[58] Field of Search ..... 169/19, 20, 26, 169/54, 56, 58, 60, 62

[56] References Cited

U.S. PATENT DOCUMENTS 1,831,193 11/1931 Quitschalle ..... 169/60 X 3,464,497 9/1969 Globerman et al. ..... 169/60

4,282,931 8/1981 Golben ..... 169/26 X

*Primary Examiner*—Andrew C. Pike

*Attorney, Agent, or Firm*—Flehr, Hohbach, Test, Albritton & Herbert

[57] ABSTRACT

A pressurized extinguishant release device with a rolling diaphragm includes a closed elongated sensor tube filled for example with 50% water and 50% ethylene glycol which terminates in an enclosure sealed by a circular head portion of the rolling diaphragm. On the other side of the head portion is a piston connected to a penetrator retained against the diaphragm by a shear pin. The penetrator is positioned above a brittle membrane which encloses a pressurized extinguishant. Heating of the liquid filled sensor tube to a certain temperature will cause a vapor pressure to push against the diaphragm head to cause the shear pin to fail propelling the penetrator into the membrane and thus allow the extinguishant to flow.

7 Claims, 2 Drawing Sheets

PRESSURIZED EXTINGUISHANT RELEASE DEVICE WITH ROLLING DIAPHRAGM

The present invention is directed to a pressurized release device using a rolling diaphragm and more particularly where the diaphragm is actuated by a liquid filled sensor tube which responds to overheat conditions.

BACKGROUND OF THE INVENTION

The use of an elongated liquid filled sensor tube which operates a diaphragm to in turn operate a water valve to extinguish a fire is shown in Wacker, U.S. Pat. No. 868,307 patented Oct. 15, 1907. Here a coiled thermostat is filled with a "confined expandable liquid such as mineral oil . . . " which when heated will actuate a diaphragm. Another type of sensor tube is, for example, illustrated in Lindberg, U.S. Pat. No. 3,277,860, which has encapsulated in it a pressurized gas which is released when heated. This is termed a capillary sensor tube.

In both of the above sensor devices, there may be problems with false alarms or limitations in reliable operation under severe ambient conditions. For example,for use in an engine compartment of an automobile, the system must work at a temperature range from −40 to +300° F.; at the :same time, because of the relatively high temperatures in an engine compartment, it cannot trigger accidentally even under relatively high temperatures.

OBJECT AND SUMMARY OF THE INVENTION

It is a general object of the present invention to provide a pressurized extinguishant release device using a rolling diaphragm.

In accordance with the above invention there is provided apparatus for extinguishing a fire with a pressurized extinguishant comprising a closed elongated sensor tube filled with a liquid having a vapor pressure which increases in response to an overheat condition which indicates the presence of a fire. A rolling diaphragm has a sealed enclosure on one side in which said sensor tube terminates and is also in fluid communication with the sealed enclosure. The diaphragm moves in response to an increase in vapor pressure. The other side of the diaphragm includes a penetrator movable with the diaphragm and carried by it. Movement of the penetrator releases the extinguishant to extinguish the fire.

PREFERRED EMBODIMENT OF THE INVENTION

Figure 1:
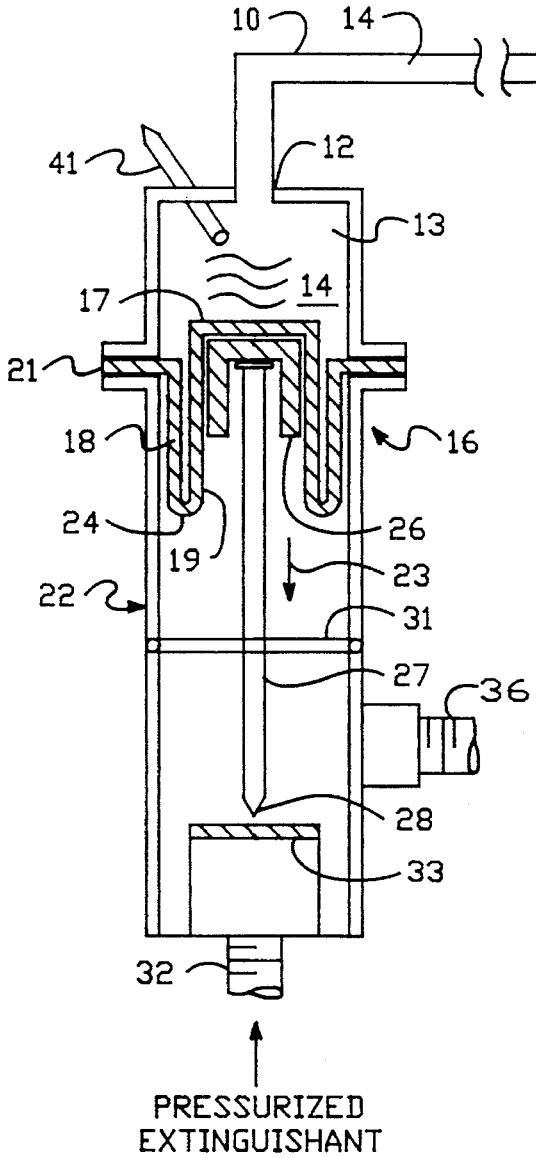
FIG. 1 is a simplified cross-sectional view of the invention.

FIG. 1 illustrates the apparatus which includes a sensor tube 10 which contains a liquid or liquid mixture 14 having a vapor pressure which increases in response to an overheat condition to indicate the presence of a fire. Thus the closed elongated tube 10 would, for example, be placed in the engine compartment of an automobile. One end 11 of the tube is crimped shut or crimped and brazed and the other end 12 terminates in a sealed enclosure 13 which is filled sealed with liquid 14 and which includes one side of a so-called rolling diaphragm system 16. The diaphragm includes a head portion 17 and a wall portion 18 which forms the tube 19, one end terminating at the circular head portion 17 and the other end 21 being sandwiched between the flanges of a cylinder 22. The upper end of the cylinder, of course, is closed and forms the sealed enclosure 13 along with the circular head portion 17.

The rolling diaphragm is commercially available from the Bellofram Corporation of Newell, W. Va. It is a nitrile coated high tensile strength cloth which is flexible and waterproof. The head portion 17 is movable in the axial direction indicated at 23 with a portion of wall 18 moving against the other wall portion to provide the rolling action, for example, as indicated at 24 to minimize friction. The concept of the rolling diaphragm is that it permits relatively long piston strokes while completely eliminating sliding friction. And the piston includes the cup shaped unit 26 to which is fixed an elongated penetrator unit 27 having a cutting tip 28. Cup unit 26 is loosely fitted within the walls 18 and the head portion 17 of the tube 19 formed by the walls. Unit 26 is clearly retained there in a releasable condition by a shear pin 31 which is affixed to the cylinder 22 and extends through the penetrator 27.

In general the rolling diaphragm permits free circumferential elongation and free rolling while preventing axial distortion. This thus eliminates stretching or ballooning during the axial movement of the head portion 17 of the diaphragm.

At the bottom of cylinder 22 there is an input fitting 32 which is coupled to a pressurized extinguishant such as water and AFFF (aqueous film forming foam; 2–10% concentration) pressurized with $CO_2$ or $N_2$ or Halon (which has been pressurized with $N_2$). The water mixture would include calcium carbonate or lithium chloride to suppress freezing.

Figure 2:
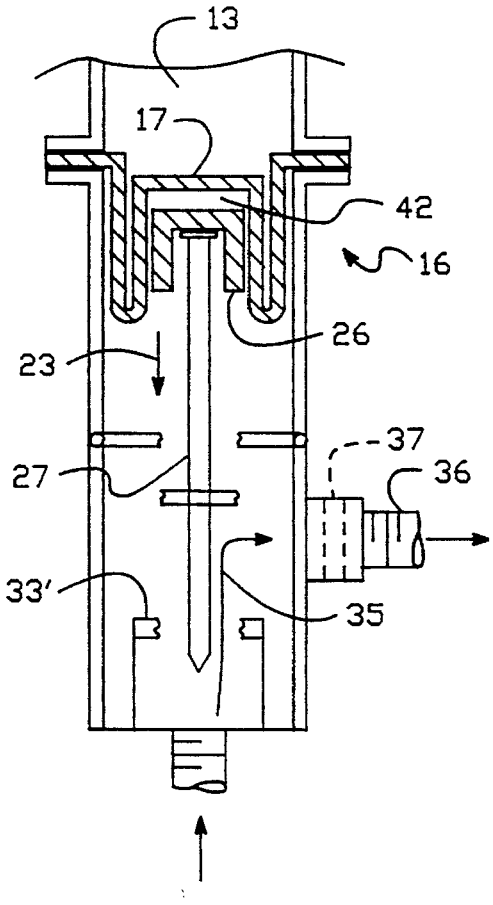
FIG. 2 is a cross-sectional view similar to FIG. 1 showing the invention in an operative condition.

Typically the pressurized extinguishant is sealed by a brittle membrane 33 which may be glass or ceramic. When the penetrator 27 fractures the membrane 33 as illustrated in FIG. 2 at 33', this releases the extinguishant as shown by the arrow 35 where the extinguishant through outlet 36 goes through proper nozzles to extinguish the fire. As shown by the dashed outlines at 37, a screen may be utilized in the outlet 36 to prevent the transmission of membrane particles 33.

Alternatively rather than a brittle membrane 33, a thin metal diaphragm maybe used where the penetrator tip 28 would cut the metal allowing it to spread open.

Figure 3:
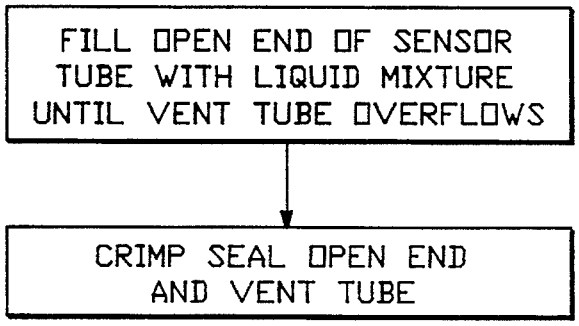
FIG. 3 is a flow chart illustrating the set up procedure for the invention.

Initially when the device is sold or installed, the sensor tube must be filled with the proper liquid. As will be discussed in connection with FIG. 4, this may include an antifreeze such as ethylene glycol mixed with water. The specific mixture is chosen to provide a resistance to freezing and also the proper failure or release point. However, initially the device must be filled with the liquid including tube 10 and sealed enclosure 13. This is done as illustrated in FIG. 3 by first filling the open end of the sensor tube 10 (this would be end 11 before it is crimped) with the liquid mixture until a vent tube 41 in sealed enclosure 13 overflows (the entire unit in FIG. 1 is positioned vertically to prevent entrapment of air). Alternatively the sealed enclosure 13 and tube 10 can be evacuated and filled with the liquid mixture utilizing ambient air pressure without the use of a vent tube. Then as shown in the second step, the vent tube is crimped sealed along with end 11 of tube 10 and can also be crimped and braze sealed. The gas pressure release device is then installed in the engine compartment of an automobile and, for example, connected to a source of pressurized extinguishant such as a water filled bottle. As discussed above a shear pin 31 both retains the piston 26 and penetrator 23 in position and provides a positive and singular release or actuation point at which a pressure build up of the liquid 14 in enclosure 13 acts on the head portion 17 to push the piston down. This is an explosive type of release. Shear pin technology is well known and very repeatable. As illustrated in FIG. 2 the piston 26 tends to act like a projectile and thus move the penetrator 27 rapidly downwardly in the direction 23 freeing itself from the diaphragm head 17. This is indicated by the gap 42. Thus the penetrator is releasably mounted to diaphragm 17 and specifically the head portion.

Shear pin 31 although it is shown as a typically round pin could be shaped like a washer with internal or external tangs or tabs. In operation the shear pin mechanism holds the pressure against the rolling diaphragm until the sensor pressure increases to the failure point of the pin.

As discussed above the penetrator is propelled toward the brittle membrane 33 which contains and holds the extinguishant under pressure. The tip of the penetrator is a carbide tipped machinist's scribe or other blunt or shaped item.

Another characteristic of the shear pin is that it allows no appreciable movement or change in system volume until the pin fails in shear. This allows the sensor to generate near the theoretical amount of pressure at a given temperature over a short length of sensor tube 10. The length of the sensor that is needed to generate an alarm is dependent on how much fluid volume is in the length of the sensor and how much change in system volume occurs when the sensor pressure increases. The shear pin keeps the change in volume very low by increasing pressure so only a short length of sensor is required to be heated to a required level to break the shear pin and discharge the extinguishant.

Figure 4:
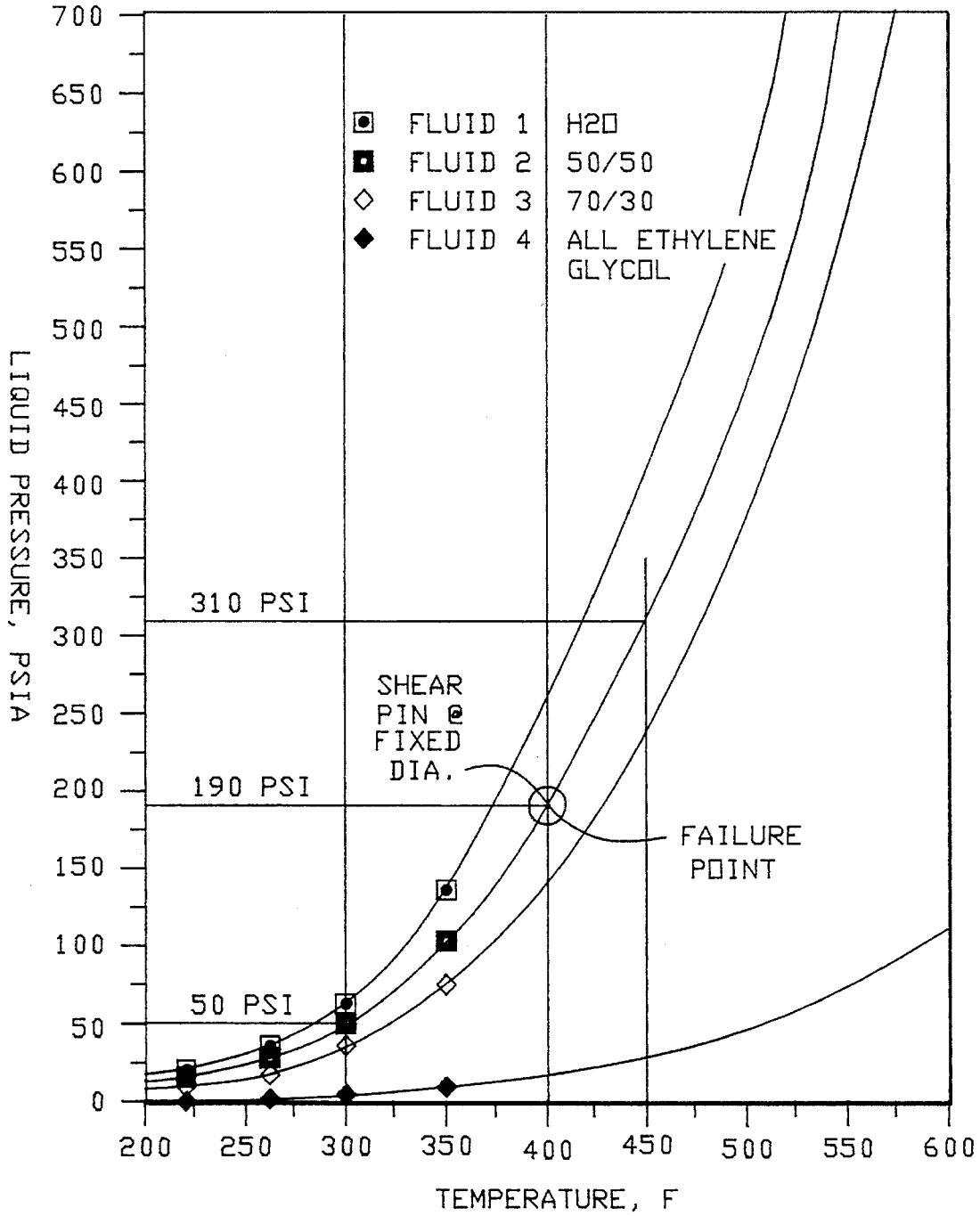
FIG. 4 is a pressure temperature curve useful in understanding the operation of the invention.

FIG. 4 is a temperature pressure diagram for theoretical pressures above 200° F. showing in effect the vapor pressure characteristics of four different fluid mixtures so labeled. The first is pure water, the last is ethylene glycol, the fluid 2 is half and half, and fluid 3 has 70% ethylene glycol and 30% water. A typical failure point is illustrated at which a shear pin of fixed or known diameter will fail. This is for the 50—50 mixture. Upon inspection of the graph of FIG. 4 it is apparent that the failure or actuation point of the release device can be changed by adjusting one or more of three parameters. These are the strength of the shear pin, the diameter of head portion 17 of the diaphragm, and the vapor pressure characteristic of the liquid. Thus referring to FIG. 4, it is quite apparent that with a 70/30% mixture, less pressure would be available to actuate the device.

Thus a pressurized extinguishant release device with a rolling diaphragm has been provided. The apparatus has the following advantages:

1. It is completely self-contained.
2. Works during a power failure.
3. Does not need a back-up power source to operate.
4. Can be remote and distant from people.
5. Needs no outside intervening to discharge extinguishant.

What is claimed is:

1. Apparatus for extinguishing a fire with a pressurized extinguishant comprising:

a closed elongated sensor tube filled with liquid having a vapor pressure which increases in response to an overheat condition which indicates a presence of said fire:

a rolling diaphragm having a sealed enclosure on one side and with which said sensor tube terminates in fluid communication, said diaphragm moving in response to an increase in the vapor pressure, said diaphragm on another side including a penetrator movable with said diaphragm and carried by said diaphragm;

shear pin means connected to said penetrator for providing a positive and singular actuation point; and means response to movement of said penetrator for releasing said pressurized extinguishant to extinguish said fire.

2. Apparatus as in claim 1 where said rolling diaphragm includes a high tensile strength, flexible and waterproof fabric having a circular head portion which carries said penetrator and a wall portion forming a tube terminating at said head portion and with a free end fixed to a cylinder which retains the tube, said tube having an axis, said head portion being movable in the direction of said tube axis by rolling of said wall portion against a wall of the cylinder.

3. Apparatus as in claim 1 where said penetrator is fixed to a cup-shaped member which is releasably mounted to said diaphragm.

4. apparatus as in claim 1 where said shear pin means provides for releasable mounting of said penetrator and cup-shaped member to said diaphragm.

5. Apparatus as in claim 1 where said actuation point is adjusted by adjusting one or more of the following parameters which include strength of said shear pin means, diameter of a portion of said diaphragm on which said liquid acts, and vapor pressure characteristics of said liquid.

6. Apparatus as in claim 1 where said releasing means includes a brittle membrane which is fractured by movement of said penetrator means and which seals pressurized extinguishant.

7. Apparatus as in claim 1 where said pressurized extinguishant is a mixture of water and 2–10% aqueous film forming foam with calcium carbonate added to said mixture to suppress freezing of said water.

* * * * *